US007304914B2

(12) United States Patent
Suk et al.

(10) Patent No.: US 7,304,914 B2
(45) Date of Patent: Dec. 4, 2007

(54) GOLF WATCH

(76) Inventors: Young J. Suk, 59 Hillary La., Westbury, NY (US) 11590; Lim Sun Hwan, Hanhwa Apt. 209, 102 Dong #598 Joong Kae Dong, Nowon, Ku, Seoul (KR)

( * ) Notice: Subject to any disclaimer, the term of this patent is extended or adjusted under 35 U.S.C. 154(b) by 109 days.

(21) Appl. No.: 11/348,106

(22) Filed: Feb. 6, 2006

(65) Prior Publication Data

US 2007/0183262 A1 Aug. 9, 2007

(51) Int. Cl.
*G04B 47/00* (2006.01)

(52) U.S. Cl. ..... 368/10

(58) Field of Classification Search ..... 368/10
See application file for complete search history.

(56) References Cited

U.S. PATENT DOCUMENTS 5,216,641 A * 6/1993 Hoel ..... 368/10
5,386,990 A * 2/1995 Smith ..... 473/131
5,523,985 A * 6/1996 Nixon ..... 368/107
5,550,884 A * 8/1996 Berney ..... 377/5
6,125,081 A * 9/2000 Flynn ..... 368/10
6,456,568 B1 * 9/2002 Geiger ..... 368/10
6,543,681 B1 * 4/2003 Wiederrecht et al. ..... 235/60 C
6,646,958 B1 * 11/2003 Geiger ..... 368/10
7,057,976 B2 * 6/2006 Berseth et al. ..... 368/10

* cited by examiner

*Primary Examiner*—Gary F. Paumen
(74) *Attorney, Agent, or Firm*—Philip M. Weiss; Weiss & Weiss

(57) ABSTRACT

A golf watch, which keeps time and allows a player to keep score of a person's golf game and records the clubs that were used during that game.

19 Claims, 3 Drawing Sheets

GOLF WATCH

FIELD OF THE INVENTION

The present invention relates to a golf watch, which keeps time and allows a player to keep score of a person's golf game and records the clubs that were used during that game.

BACKGROUND OF THE INVENTION

U.S. Pat. No. 6,125,081 relates to a golfer's wristwatch with score keeping capabilities comprising a watch component including a front face, a watch case, time display means and a plurality of side edges. The front face of the watch component includes a liquid crystal display window. The display window includes a plurality of player numerals. The display window also includes stroke count means displayed numerically adjacent to the player numerals. A side edge of the watch case includes a time adjustment knob and a player indicator knob, the player indicator knob being coupled to the numerals of the display window to highlight a specific player numeral. A stroke count button is coupled to the stroke count means of the display window whereby each depression of the button causes the addition of one stroke to a player's score.

U.S. Pat. No. 6,646,958 relates to a golfer's watch having a mechanism which includes a first mechanical counter for counting a number of strokes of a golf hole. The first mechanical counter has a mechanical display and a mechanical drive for advancing the count and for positioning the mechanical display based on the count. A second mechanical counter counts a total number of strokes played for a series of golf holes.

U.S. Pat. No. 6,456,568 relates to a golfer's watch which includes an analog counter for the strokes taken on a hole, and a counter of the total number of strokes of the game.

U.S. Pat. No. 5,550,884 relates to a golf counter device and watch. An analogue display golf counter comprises a first example four hands independent of each other driven by four stepping motors. The position of the hands is controlled by an electronic system comprising counting, storing, processing and control means in response to programmed algorithms and to data introduced by means of two pushers. The first hand indicates the course position (hole), the second the operating mode, and the last two the number of points, one displaying the units with the sign and the other the tens. There are three operating modes, simple total, cumulative total, and programming.

SUMMARY OF THE INVENTION

The present invention relates to a golf watch having several functions. It is an object of the present invention for the watch to be used for daily use to tell time. It is an object of the present invention for the watch to be water-proof so that it can resist splashing and rain, but can not be put in water or used for diving.

It is an object of the present invention for the watch to be made out of stainless steel or a silicon band.

It is an object of the present invention for the watch to have two modes, a first mode for keeping standard time and a second mode for keeping a golf score.

It is an object of the present invention for the watch to have an adjust mode. It is an object of the present invention for the adjust mode to adjust the decimal carry of the hour, minute, second, month day and year. It is an object of the present invention for the adjust mode to have a stop, start and change score mode for the golf score.

It is an object of the present invention for the watch to have a memory mode. It is an object of the present invention for the memory mode to allow a user to adjust the hour, minute, second, month, day and year of the time function. It is an object of the present invention for the memory mode to keep in memory or delete the golf scores.

It is an object of the present invention for the watch to have an hour mode for keeping the total hours of playing golf.

It is an object of the present invention for the watch to have a total mode for keeping the total golf scores.

It is an object of the present invention for the watch to track the number of times a user uses a different club. It is an object of the present invention for the watch to track the number of times a user uses their wood. It is an object of the present invention for the watch to track the number of times the user uses their iron. It is an object of the present invention for the watch to track the number of times the user uses their putter. It is an object of the present invention for the watch to track which number club is used. It is an object of the present invention for the watch to track the number of times that the user reaches the fairway, sand, or any other hazard or hits the ball out of bounds.

It is an object of the present invention for the watch to track the distances hit by each club.

It is an object of the present invention for the watch in golf mode to display the hour and minutes played in the golf game and the golf club times of wood, iron and putter.

It is an object of the present invention to keep the score of the golf game.

It is an object of the present invention for the watch to have a night light function.

DETAILED DESCRIPTION OF THE INVENTION

Figure 1:
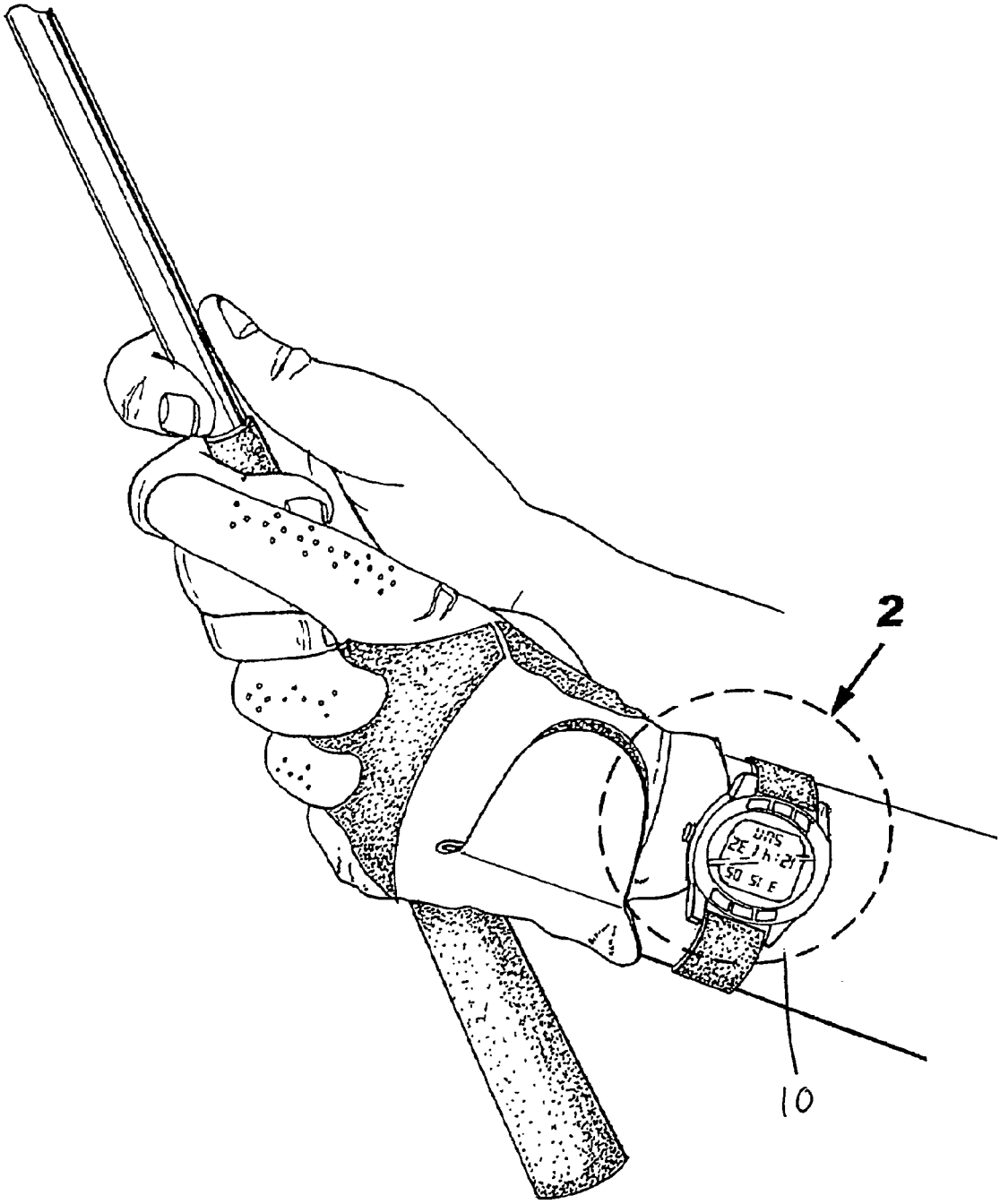
FIG. 1 is an illustration of the watch of the present invention on a user's arm.

FIG. 1 is an illustration of the watch 10 of the present invention worn on a user's arm.

Figure 2:
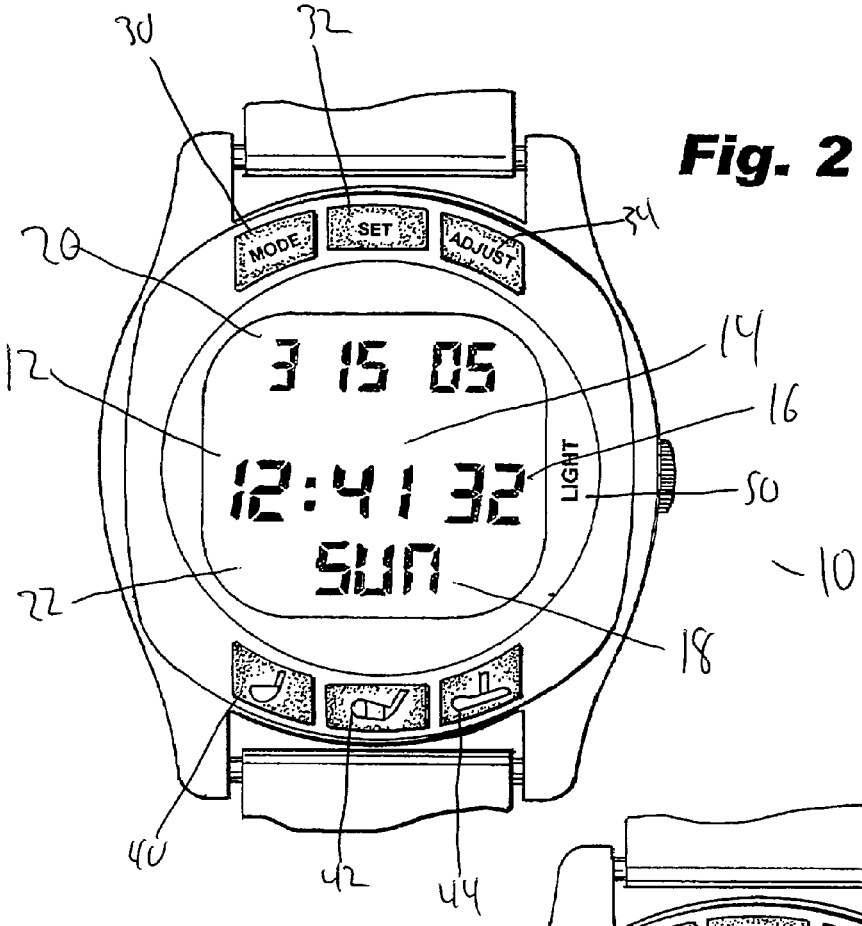
FIG. 2 is an illustration of the watch in the time mode.

FIG. 2 is an illustration of the watch 10 of the present invention showing the watch in time mode. The watch shows the time in hours 12 minutes 14 and seconds 16, and also shows the day 18 and the date 20. The outside of the crystal 22 shows the buttons for mode 32, adjust 36 and memory 34. The outside of the watch also shows buttons for golf clubs, including wood 40, iron 42 and putter 44. The watch also comprises a light 50.

Figure 3:
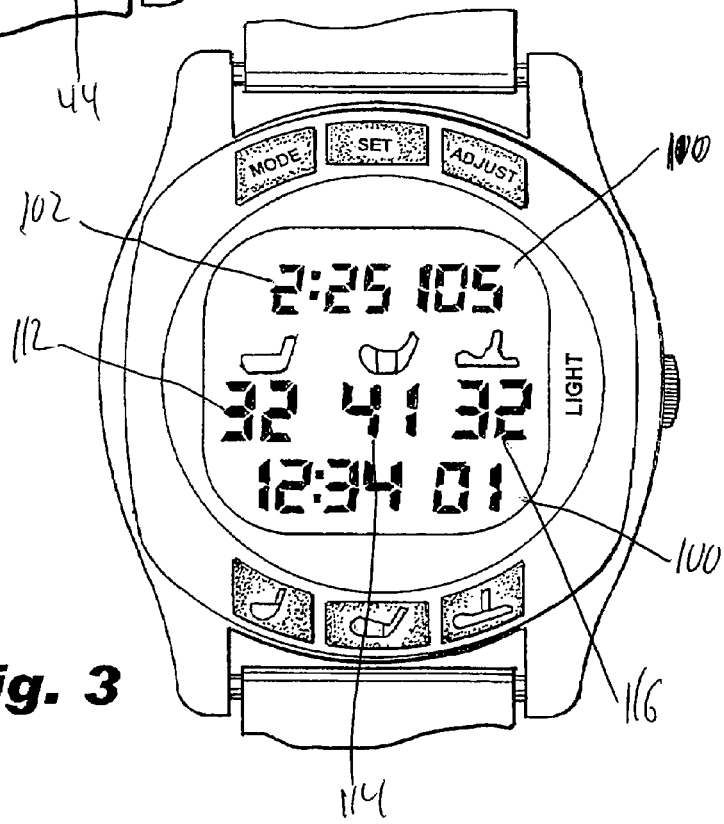
FIG. 3 is an illustration of the watch in the golf mode.

FIG. 3 shows an illustration of the watch of the present invention showing the watch in golf mode. The watch still gives the time of day 100 to the user. The watch also provides the user with the amount of time 102 that the user is playing golf. The watch also tells the user the total number of strokes 110 and the total number of strokes for woods 112, irons 114 and the putter 116.

Figure 4:
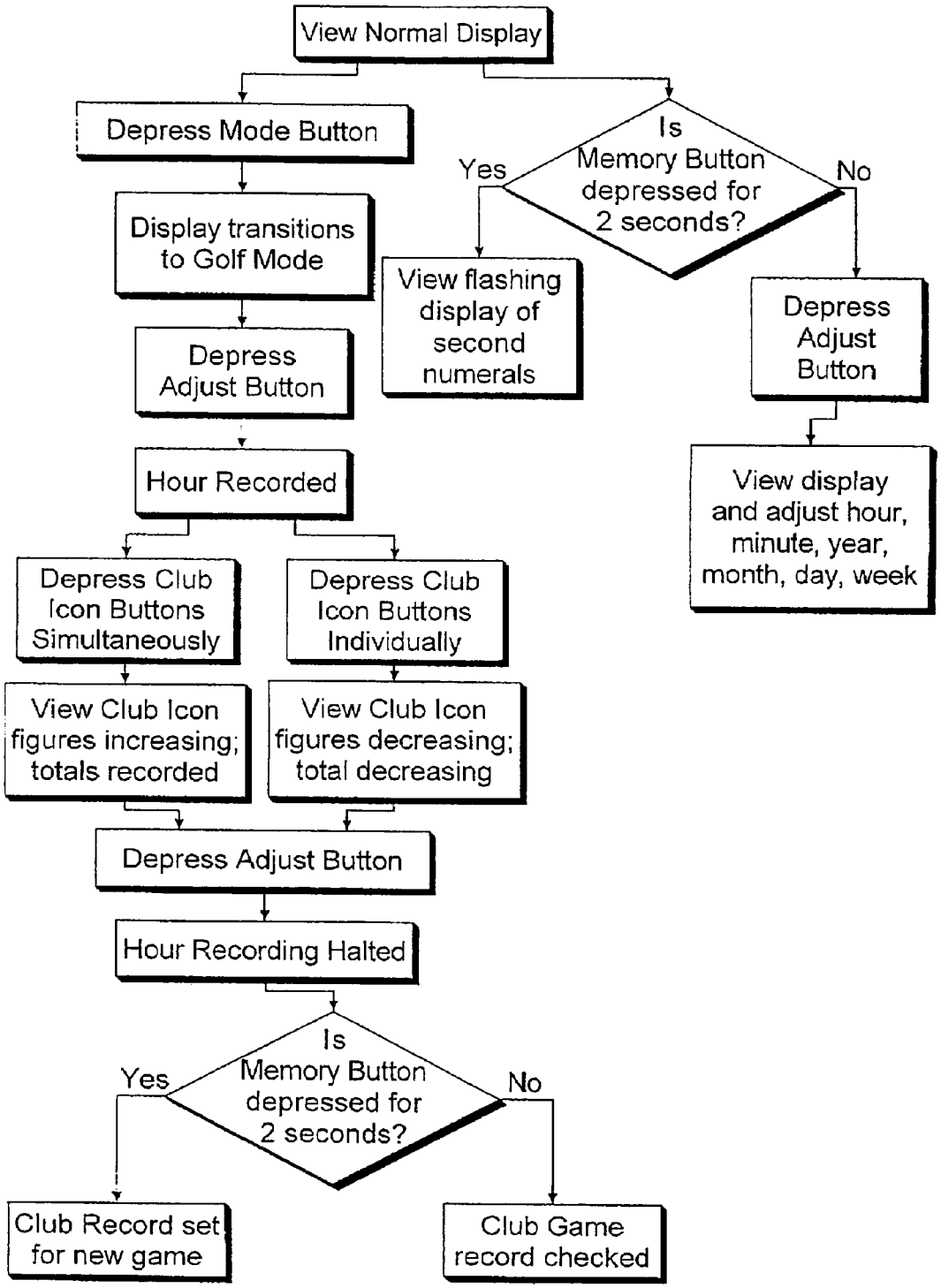
FIG. 4 is a diagram showing the different functions of the watch.

FIG. 4 shows a diagram relating to how the watch works in both the time mode and the golf mode. In an embodiment, in the normal display mode, if one presses the memory button for a period of time, the seconds digital flashes. By continuing to press the memory mode, a user is able to adjust the hours, minutes, year, month, day and week.

One can change from the time display mode to the golf display mode by pressing the mode button. Once in the golf display mode one presses the adjust mode to record the hour one starts to play golf. Once than can press the wood button, iron button, and putter button. According to which club is used the right button is pressed to increase the figures and the total record of the clubs used. At the end of the round of golf one presses the button to stop the time from recording the golf game. By then hitting the memory button one can add this game to memory and create a new game record. By reviewing the memory, one can also review other scores and games of golf that were played.

The invention claimed is:

1. A golf watch comprising:

two modes, a first mode for keeping standard time and a second mode for keeping a golf score;

further comprising an adjust mode, and a memory mode; and having a function for tracking the number of times a user uses a different club.

2. The watch of claim 1 wherein said watch is waterproof.

3. The watch of claim 1 wherein said watch is made of stainless steel or a silicon band.

4. The watch of claim 1 wherein said adjust mode allows a user to adjust hour, minute, second, month day and year of said standard time.

5. The watch of claim 1 wherein said adjust mode comprises a stop, start and change score mode for said golf score.

6. The watch of claim 1 wherein said memory mode allows a user to adjust hour, minute, second, month, day and year of the time function.

7. The watch of claim 1 wherein said memory mode keeps in memory or allows a user to delete said golf scores.

8. The watch of claim 1 wherein said watch has a function for keeping total hours of playing golf.

9. The watch of claim 1 wherein said watch comprises a total mode for keeping total golf scores.

10. The watch of claim 1 wherein said watch tracks number of times a user uses wood, iron, or putter.

11. The watch of claim 1 wherein said watch tracks which number club is used.

12. The watch of claim 1 wherein said watch tracks number of times user reaches fairway, sand, or any other hazard or hits ball out of bounds.

13. The watch of claim 1 wherein said watch tracks distances hit by each club.

14. The watch of claim 1 wherein said watch in said golf mode display hour and minutes played in golf game and golf club times of wood, iron and putter.

15. The watch of claim 1 wherein said watch comprises a night light function.

16. The watch of claim 1 wherein a user can change from said time display mode to said golf display mode by pressing said mode button.

17. A golf watch comprising:

a watch which shows time in hours and minutes and shows day and date within crystal of said watch;

outside of said crystal are buttons for changing mode, adjust and memory;

the outside of said watch further comprises buttons for counting the number of times a golfer uses a wood, iron and putter.

18. The watch of claim 17 wherein said watch keeps the amount of time user is playing golf.

19. The watch of claim 17 wherein said watch further comprises:

a light.

* * * * *